United States Patent [19]

Vydrin et al.

[11] 4,199,970

[45] Apr. 29, 1980

[54] METHOD AND MILL ROLLS FOR METAL BAR ROLLING

[76] Inventors: Vladimir N. Vydrin, ulitsa Timiryazeva, 28 kv. 27; Evgeny N. Berezin, ulitsa Engelsa, 28, kv. 72, both ofChelyabinsk; Oleg I. Tischenko, Karagandinkoi oblasti, ulitsa Lenina, 6/3, Temirtau; Vladimir G. Dremin, ulitsa Beloretskaya, 70, kv. 22; Grigory I. Koval, ulitsa Estonskaya, 2, both of Chelyabinsk, all of U.S.S.R.

[21] Appl. No.: 913,330

[22] Filed: Jun. 7, 1978

[51] Int. Cl.[2] ..... B21B 1/10; B21B 1/00

[52] U.S. Cl. ..... 72/186; 72/204; 72/221

[58] Field of Search ..... 72/189, 204, 214, 186, 72/221, 366

[56] References Cited

U.S. PATENT DOCUMENTS

| | | | |
|---|---|---|---|
| 1,977,285 | 10/1934 | McCleery | 72/204 |
| 3,209,452 | 10/1965 | Schneckenburger | 72/204 X |
| 3,374,654 | 3/1968 | Uebing | 72/189 |
| 3,439,519 | 4/1969 | Gerding | 72/189 |

FOREIGN PATENT DOCUMENTS

| | | |
|---|---|---|
| 231628 | 2/1964 | Austria . |
| 1063618 | 3/1967 | United Kingdom . |

*Primary Examiner*—Milton S. Mehr
*Attorney, Agent, or Firm*—Fleit & Jacobson

[57] ABSTRACT

The present invention relates to plastic working of metals and the reducing of a workpiece along its axis by a pair of shaped rolls with formation in the workpiece of a transitional length whose cross section gradually changes from a starting one to several cross sections of finished bars interconnected by webs. The reduction of the workpiece is alternated with its axial displacement through one feed step, whereas at the end of a transitional length adjacent bars are displaced one with respect to another in opposite directions perpendicularly to webs so as to separate the bars. Mill rolls used with the method have several grooves of a variable cross section which form passes for rolling bars. The profile of each groove in transversal (with respect to mill roll axis of rotation) cross section is formed of two mutually conjugated arcs successively coming into contact with the workpiece. The grooves have an arc for reducing the workpiece and an arc for dividing bars one from another. The centers of curvature of the arcs are located at different eccentricities with respect to the mill roll axis of rotation, with the directions of eccentricity alternating in adjacent grooves.

5 Claims, 10 Drawing Figures

METHOD AND MILL ROLLS FOR METAL BAR ROLLING

BACKGROUND OF THE INVENTION

The present invention relates to plastic working of metals, and, in particular, to a method of metal bar rolling and to mill rolls for carrying said method into effect.

FIELD OF THE INVENTION

The invention can be advantageously used in hot bar rolling, preferably of square bars from ingots obtained in a continuous caster.

DESCRIPTION OF THE PRIOR ART

There are known methods for metal bar rolling (see, e.g., Federal Republic of Germany Pat. No. 1,433,023 Cl. B22 d 11/12), which comprise reducing a workpiece along its axis by a pair of shaped mill rolls with formation on said workpiece of a transitional length of a variable cross section progressively changing from initial cross section of the workpiece to several cross sections of finished bars interconnected by webs.

To realize said method it is necessary that the cross sectional area of the workpiece be equal to at least the sum of cross sectional areas of the finished bars, with the width thereof being not greater than the total width of closed passes of the mill rolls.

There are also widely known in the prior art shaped mill rolls for carrying out said bar rolling methods. Each said mill roll has on its workpiece-contacting surface several grooves of variable cross sections, which form with the corresponding grooves on a mating mill roll passes wherein bars are rolled.

In the prior art methods, shaped mill rolls, after biting a workpiece (a continuously cast ingot) reduce said workpiece throughout the duration of continuous casting. Each mill roll contacts the workpiece throughout the transitional length thereof from the original workpiece to finished bars as the transitional length is, lengthwise with respect to the workpiece, substantially equal to the length of the deformation zone induced in the workpiece by each mill roll at each given moment of time.

Under said operating conditions, mill rolls suffer from severe process loads, this requiring an increase in their size and in that of chocks, stand frame, and, in consequence, in the mass of the latter.

Moreover, pass design of known mill rolls makes possible a reduction (deformation) of a workpiece with its division into several bars interconnected by webs, the latter then being removed in a separate stand, said procedure complicating the method as a whole.

It should also be borne in mind that a practical accomplishment of the prior art bar rolling involves problems as regards biting of stock by mill rolls under steady-state operating conditions, as the degree of deformation at the webs may attain 100%.

Elimination of said disadvantages calls for a substantial increase in the diameter of mill rolls which is an inefficient means.

In the prior art bar rolling, original workpieces are ingots from continuous casters, the cross section area of each ingot being equal to at least the sum total of cross sectional areas of finished bars, and the width, not greater than the total width of closed passes of mill rolls.

When rolling ingots whose cross sectional width is less than the sum total of widths of closed passes (ingot being entered along the pass centre line), the volume of metal taken by the extreme passes is less than that entering the middle passes. Because of this, individual reductions of bars rolled in the extreme passes are smaller than those of the middle passes. Therefore, under steady-state rolling conditions, the lengths of the extreme and the middle bars differ.

Subsequent transversal shearing of said bars interconnected by webs results in a substantial amount of end crops.

Moreover, characteristic of steady-state rolling in accordance with the prior art is that the drafts a workpiece experiences tend to level off on exit from the mill rolls, and due to this metal from the middle passes (where reduction of metal is at its greatest) flows over to the extreme passes (where reduction of metal is lower). Said flow of workpiece metal from pass to pass increases the consumption of power for the deformation of the metal.

When the width of an ingot is equal to the total width of passes, laps are formed on faces of bars rolled in the extreme passes, and, in consequence, said bars feature a lesser draft than those rolled in the middle passes. This is due to different flows of stock metal in the extreme and in the middle passes: in the extreme passes, metal can spread by flowing between roll collars, this giving rise to laps.

In addition to said shortcomings, workpieces of rectangular cross section suffer from collar marks on edge faces. This is due to that the layers in contact with the mill rolls spread out transversally in the course of reduction, then build up (crowd) to form a collar mark.

SUMMARY OF THE INVENTION

It is an object of the invention to provide a method and mill rolls for metal bar rolling which will lower loads upon mill rolls and thus make it possible to reduce their size and mass and the requirements in floor space for bar rolling equipment integrated with a continuous caster.

Another object of the present invention is to provide a method for bar rolling which will reduce the amount of end crops from bar shearing and improve the quality of finished bars.

Still another object of the invention is to bring down the consumption of energy for deforming workpieces in metal bar rolling.

A further object of the invention is to minimize wear of mill roll passes and to design passes which will make it possible to reduce stock and divide it into separate bars in a single pair of mill rolls in a single pass.

These and other objects are accomplished by a method for metal bar rolling by reducing workpieces along their axes by one pair of shaped mill rolls with formation on said workpieces of a transitional length of a cross section progressively varying from the original cross section of a workpiece, the area thereof being equal to at least the sum total of areas of transversal cross sections of finished bars and the width thereof being not more than the total width of closed passes of mill roll. The total width is equal to the width of several cross sections of finished bars interconnected by webs. According to the invention, the reduction of a workpiece is alternated with its axial displacement through one step, whereas at the end of the transitional length adjacent bars are shifted one with respect to another in opposite directions perpendicularly to webs in order to separate said bars.

Alternation of reduction of a workpiece with its axial displacement makes it possible to accomplish bar rolling at substantially lesser process loads upon mill rolls than in the prior art methods.

This is achieved by considerably increasing the extent of the transitional length and decreasing that of the instantaneous zone of deformation induced in a workpiece by each mill roll at each given moment of time as compared to that of the zone of deformation in prior art rolling.

The displacement of adjacent bars at the end of the transitional length perpendicularly to webs makes it possible, at the end of each reduction pass, to separate reliably finished bars one from another, to simplify bar rolling and to prevent sticking of burrs to bars and to webs between them and so substantially improve the quality of bars.

It is expedient that the original workpieces be prefabricated in cross sections shaped essentially as rectangles whose larger sides feature convex stretches at edges and smaller sides are rounded off, said workpieces being fed into the passes of mill rolls in a manner to work said convex stretches in the extreme passes of mill rolls.

It is also advantageous to set the width of each convex stretch smaller than the width of the corresponding extreme pass by the value of the spread of the corresponding extreme bar.

Provision in a workpiece of said convex stretches makes it possible, in subsequent rolling, to level off the longitudinal deformation (draft) of stock in all the passes and thus to bring down the amount of end crops in transversal shearing of bars.

This is achieved by spreading workpiece metal in the extreme passes, and, therefore, levelling off of the volumes of metal taken by the extreme and by the middle passes.

An upshot of this is that metal no longer flows over from pass to pass, this minimizing both the consumption of power for deformation of workpieces and the wear of passes.

Rolling of stock with rounded off edges prevents backfins at edges of extreme bars, i.e., improves the quality of bars.

These and other objects are attained also in mill rolls for carrying said method for metal bar rolling into effect, each mill roll having on its surface contacting workpieces several grooves of variable cross section, forming, with corresponding grooves on a mating mill roll, passes wherein bars are rolled. In accordance with the invention, the profile of each groove of the mill roll transversally to the geometric axis of rotation of the mill roll has a cross section formed by an arc for reducing stock and a conjugate arc for dividing bars, the centre of curvature of the arc of reduction being located with respect to said geometric axis of rotation of the mill roll at an eccentricity determined by the expression $$e_1 \geqq (D-2\rho_1-H)/(2\cos\delta)$$

where

D = distance between geometric axes (O) of rotation of mill rolls;

$\rho_1$ = radius of curvature of arc of reduction;

H = thickness of workpiece;

$\delta$ = angle between two radii limiting the arc of reduction and drawn from the geometric axis of rotation of mill roll, whereas the centre of curvature of arc of division is located with respect to said axis (0) at an eccentricity of at least half the thickness of web between bars at the end of the transitional length, the direction of said eccentricity alternating in adjacent grooves.

Since the profile of each groove of a sector-type mill roll consists of two such arcs, it is then possible to reduce workpieces and to effect their final division into several finished bars in a single stand and in a single pass, this simplifying bar rolling as a whole and cutting down its cost.

The recommended eccentricity of the centre of curvature of the arc of reduction of the mill roll profile ensures a necessary gap intermediate mill rolls to axially displace the workpiece, through one feed step before each work travel of live sector mill rolls and to subsequently reduce workpieces in oscillatory and translational motions of sector mill rolls.

The eccentricity of the arc of division of bars and the alternation of its direction in adjacent passes makes possible a reliable division of adjacent bars and an improvement in their quality.

BRIEF DESCRIPTION OF THE DRAWINGS

The invention will now be explained in greater detail with reference to embodiments thereof which are represented in the accompanying drawings, wherein.

A method for metal bar rolling in accordance with the invention is illustrated by way of a manufacture of square bars from workpieces such as ingots obtained in continuous casters.

Figure 2:
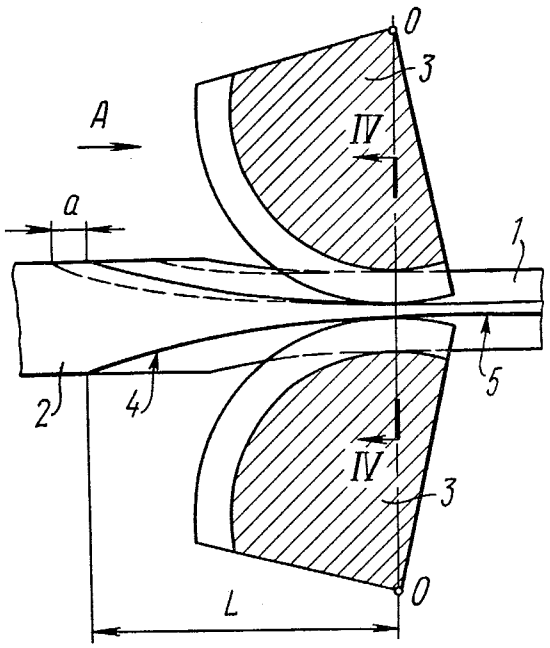
FIG. 2 is the same as FIG. 1, but mill rolls are conventionally shown near the end of the transitional length.
Figure 1:
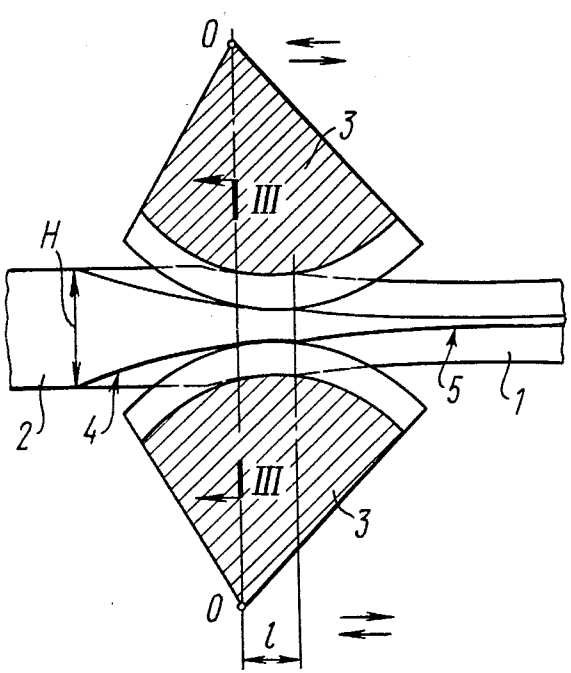
FIG. 1 is a schematic representation of a method for metal bar rolling in accordance with the invention (mill rolls located on the transitional length of a workpiece in an intermediate position)

A method of metal bar rolling of bars 1 (FIGS. 1 through 4) consists in reducing a workpiece 2 along its axis by a pair of sector shaped mill rolls 3, a transitional length then forming on the workpiece 2. The cross section of said transitional length 4 progressively changes as the workpiece 2 is being reduced from an original workpiece 2 cross section of thickness "H" (FIG. 1) to several cross sections of finished bars 1 interconnected by webs 5 of thickness "h".

In accordance with the invention, the reduction of the workpiece 2 is alternated with its axial displacement towards a lesser magnitude of its cross section (along arrow "A" on FIG. 2) through a feed step "a". Length "L" of the transitional length 4 actually surpasses then a length "1" of the instantaneous zone of deformation induced in the workpiece 2 by each mill roll 3 at each given moment of time. Because of this, mill rolls 3 suffer, in said step rolling, from substantially lesser process loads than in prior art methods of continuous rolling.

At the end of the transitional length 4, adjacent bars 1 are displaced, according to the invention, one with respect to another in opposite directions (along vertical arrows on FIG. 4) perpendicularly to webs 5.

Further advantages of a method for metal bar 1 rolling in accordance with the invention will become apparent from the reading of the specification of mill roll 3 for carrying the method into effect.

Figure 3:
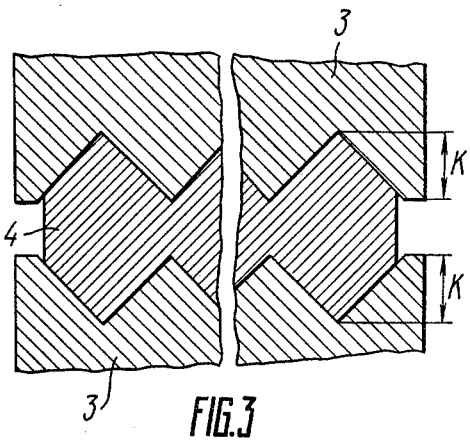
FIG. 3 is a section at III—III on FIG. 1 on a larger scale.
Figure 4:
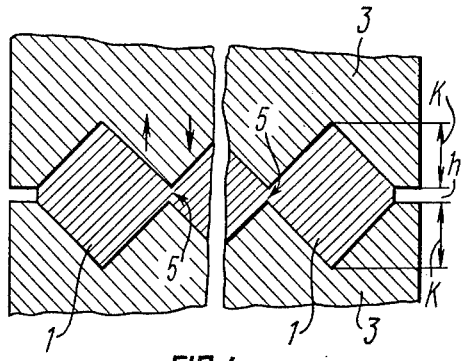
FIG. 4 is a section at IV—IV on FIG. 2 on a larger scale.

In step rolling use is made of sector mill rolls 3 having on their surface in contact with the workpiece 2 several parallel grooves 6 (FIGS. 5 through 8) of variable cross section which in combination with corresponding grooves 6 on a mating mill roll 3 form several passes 7 wherein bars 1 are rolled (as shown on FIGS. 3 and 4). The number of passes 7 corresponds to that of bars 1 into which the workpiece 2 is divided.

Each mill roll 3 is in cross section, a sector located eccentrically with respect to the geometric axis "O" (FIG. 5) of rotation of mill roll 3.

According to the invention, the profile of each groove 6 of mill roll 3 in a direction transversal to its geometric axis "O" has a cross section formed by two arcs of circular sector that successively contact the workpiece 2, i.e., arc CD of reduction of the workpiece 2 and its conjugated arc DE of division of finished bars 1 at the end of the transitional length 4 formed on the workpiece 2 as it is being reduced by the arc CD of reduction.

The arc "CD" of reduction of the profile of groove 6 is drawn at a radius "$\rho_1$" from centre $O_1$ of its curvature located with respect to the geometric axis "O" of rotation of mill roll 3 at an eccentricity "$e_1$", and the arc "DE" of division, at a radius "$\rho_2$" from its curvature centre "$O_2$" located at a different eccentricity "$e_2$" with respect to the geometric axis "O" of rotation of mill roll.

The eccentricity $e_1$ of the centre "$O_1$" of curvature of the arc CD of reduction should be equal to at least the original thickness "H" of the workpiece 2 in order to ensure intermediate sector mill rolls 3 a gap necessary for axial displacement of the workpiece 2 through a feed step "a" prior to the working travel of mill rolls 3 and for subsequent reduction of the workpiece 2 in the course of their oscillatory and translational motions.

The eccentricity "$e_1$" of the centre "$O_1$" of the arc CD curvature may be determined with greater accuracy by means of the expression $$e_1 > (D - 2\rho_1 - H)/(2 \cos \delta)$$

where:

D = distance between the geometric axes (O) of rotation of mill rolls;

$\rho_1$ = radius of curvature of arc "CD" of reduction;

H = thickness of workpiece 2;

$\delta$ = angle between two radii R and $R_1$ limiting the arc "CD" of reduction and drawn from the geometric axis "O" of rotation of mill roll 3.

The eccentricity "$e_2$" of the centre "$O_2$" of the arc "DE" of division should be equal to at least half the thickness "h" of the web 5 intermediate bars 1 at the end of the transitional length 4 of the workpiece 2.

Figure 9:
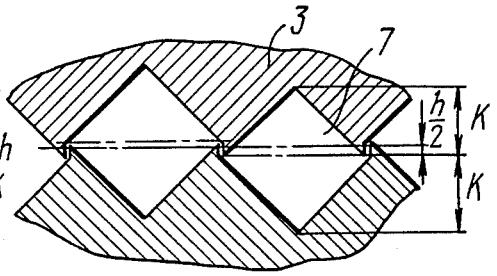
FIG. 9 is a cross section at IX—IX on FIG. 7 on a larger scale.

The direction of said eccentricity $e_2$ with respect to axis "O" of rotation of mill roll 3 alternates in adjacent grooves 6, i.e., the arc "DE" of division is drawn in the adjacent grooves 6 from centre "O" alternately at different radii $\rho_2$ and $\rho_3$ (where: $\rho_3 = \rho_2 + h/2$). This ensures alternate mutual radial displacement of the centres of adjacent passes 7 (see FIG. 9) through one half the thickness "h" of webs 5 (intermediate bars 1, and, therefore, mutual displacement of adjacent bars 2 in opposite directions perpendicularly to webs 5 owing to which webs 5 are cut off, and bars 1, divided.

Figure 10:
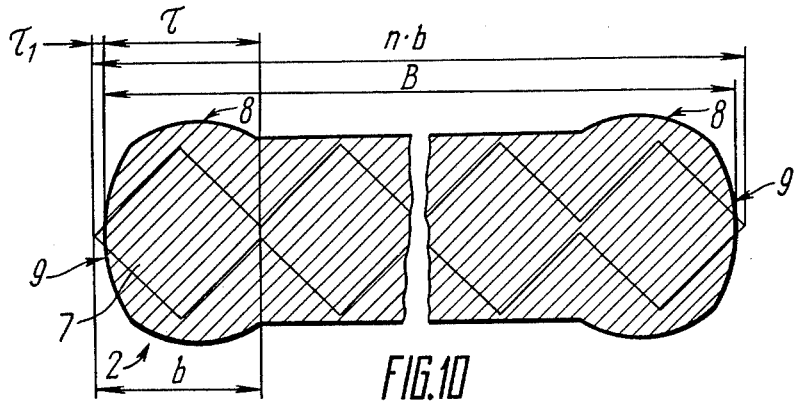
FIG. 10 is a general cross sectional view of a workpiece in accordance with the invention.
Figure 8:
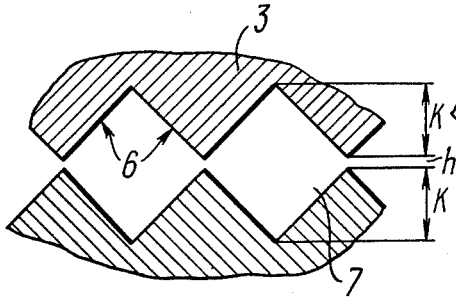
FIG. 8 is a cross section at VIII—VIII on FIG. 6 on a larger scale.

In metal bar 1 rolling, generally used is the workpiece 2 of a rectangular cross section whose area is equal to at least the sum total of areas of cross sections of finished bars 1 and whose width "B" (FIG. 10) is not greater than the total width "n·b" of the closed passes 7 of mill rolls where "b" is the width of each closed pass 7, and "n", the number of the passes 7 shown conventionally in thin lines on the workpiece cross section (FIG. 10).

To minimize crops from transversal shearing of bars 1 after they are rolled and to improve their quality, the workpiece 2 is prefabricated with convex stretches 8 on the larger sides of its cross section, whereas the smaller sides 9 of the cross section are rounded off, i.e., are also convex.

Width "$\tau$" of each convex stretch 8 should be smaller than width "b" of the extreme passes 7 by the magnitude of spread "$\tau_1$" of the corresponding extreme bars 1.

Square metal bars 1 are rolled in sector mill rolls 3, in accordance with the invention, in a manner below.

Produced in a continuous caster is a wide ingot of a constant thickness in its middle part, with convex stretches 8 at the edges of the wider faces and with rounded off side edges 9.

Once delivered by a caster, an ingot is cut to standard lengths and the resultant workpiece 2 is engaged into a two-high pendulum roll mill 3, or into sector mill rolls 3 with multigroove square passes 7. Each stock 2 is entered into rolls so as to work its convex stretch 8 in extreme passes 7.

Prior to a working travel of the sector mill rolls 3, their passes 7 are opened to a maximum to form a gap intermediate mill rolls 3 sufficient to allow the workpiece 2 to pass between them, the workpiece 2 being moved axially along arrow A (FIG. 2) through one feed step.

Next, mill rolls 3 are reciprocated along the axis of the workpiece 2 with simultaneous oscillation about the geometric axes "O" of their rotation.

Figure 5:
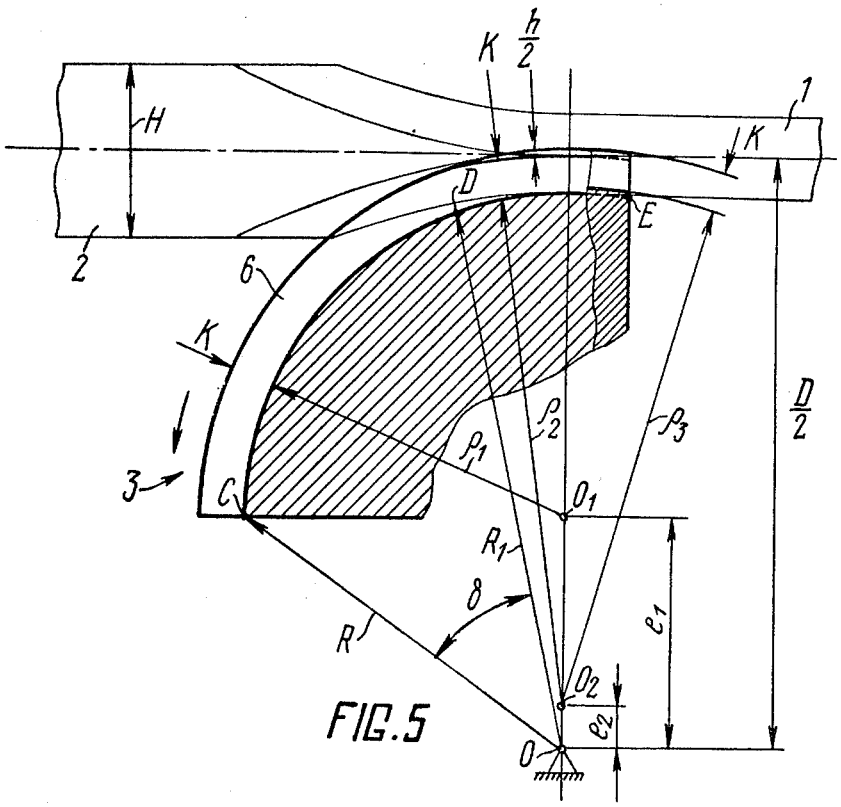
FIG. 5 is a general view of the shaped part of a sector mill roll in accordance with the invention (cross section at a single groove and a partial section of a groove adjacent to the former)
Figure 6:
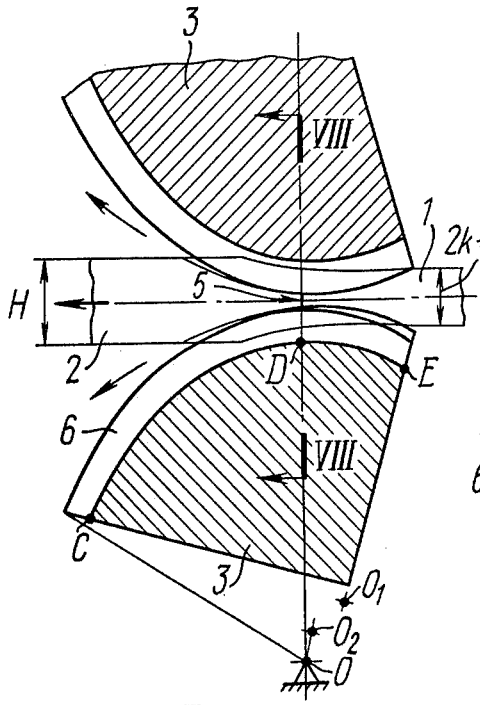
FIG. 6 shows mill rolls in a position when reducing a workpiece.
Figure 7:
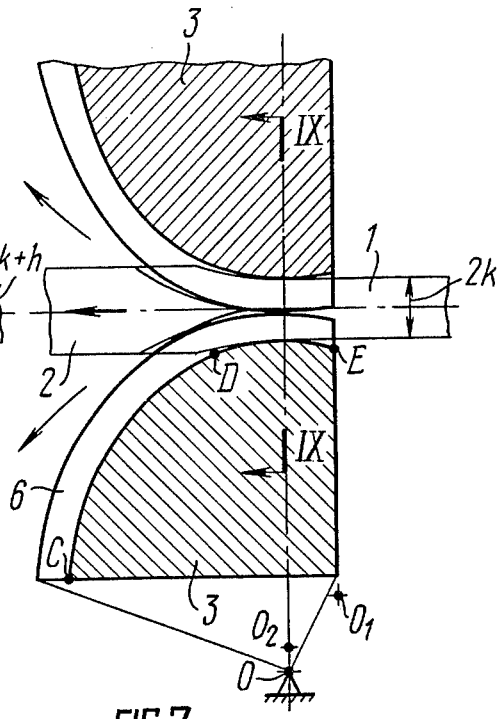
FIG. 7 is the same as FIG. 6, but with mill rolls shown in a position when dividing bars.

During the working travel of the sector mill rolls 3, whose direction is shown on FIGS. 5 through 7 by curved arrows the workpiece 2 is first contacted by the surfaces of the mill rolls 3 on length CD of reduction of the workpiece 2. In the course of reduction, formed on the workpiece 2 is a transitional length 4 (FIGS. 1 and 2) whose cross section area progressively changes throughout its height from thickness "H" (FIG. 5) of the original cross section of the workpiece 2 down to a magnitude 2k+h, where 2k is the height of the cross section of the finished bar 1 (along the diagonal of the square), and h, the thickness of the web 5 at the end of the transitional length 4 on the workpiece 2.

At the end of the transitional length 4 the workpiece 2 is contacted by surfaces of mill rolls 3 on the lengths of the arcs DE of division which bring the height of cross section of the workpiece 2 to a magnitude 2k (FIG. 9) of the finished bar 1. This is achieved by displacing the adjacent bars 1 in the adjacent passes 7, whose centres on the length of the arc DE are offset one with respect to another by half the thickness "h" of the webs 5.

After a final division of the workpiece 2 into several finished bars 1, mill rolls 3 effect a return idle run during which the workpiece 2 is moved axially through one step "a".

After this, the reduction of the workpiece 2 and its division into bars 1, and the alternations of these operations with the axial feed of the workpiece 2 are repeated as described above.

The proposed method and the sector mill rolls for bar rolling make it possible to lower loads upon mill rolls and to reduce and finally divide the workpieces into bars in a single mill stand with a single pair of mill rolls, and thus to simplify and lower operating costs of bar rolling as a whole.

Used as workpieces in said method are ingots with convex stretches 8 at the edges and rounded off side faces 9, this ensuring the equality of the volumes of metal of the workpiece 2 rolled in each of the passes 7, reducing the amount of end crops in transversal shearing of the bars 1 after they are rolled by more than a factor of 2 and improving the quality of the bars rolled in the extreme passes.

In addition, the consumption of energy for deforming workpieces and the wear of passes are reduced since no metal flows from pass to pass.

An increase in the size of ingot cross section and a lesser wear of passes greatly enhances the productivity of continuous casters in which ingots are cast.

We claim:

1. A method for metal bar rolling a workpiece having a longitudinal axis, using a pair of shaped metal rolls defining therebetween a plurality of substantially closed passes, adjacent passes being off-set from each in a direction perpendicular to the longitudinal axis of a workpiece passing through the rolls, the workpiece having a cross sectional area equal to at least the sum total of cross sectional areas of finished bars formed by the closed passes and the width of the workpiece being not more than the total width of closed passes, said method comprising:

forming a gap between the metal rolls;

passing the workpiece through the metal rolls so that the workpiece is reduced and a transitional zone of variable cross section is formed in the workpiece, the zone progressively changing in the course of reduction from an original cross section to several cross sections interconnected by webs; and reciprocating the metal rolls along the axis of the workpiece while simultaneously oscillating the rolls so that a plurality of finished bars are formed, the off-set of adjacent passes dividing the bars from each other.

2. A method as claimed in claim 1 in which the workpiece cross section has essentially the shape of a rectangle whose larger sides feature convex stretches at the edges and the smaller sides are rounded off, said workpiece being engaged into the passes of mill rolls in a manner to work said convex stretches in the extreme passes.

3. A method as claimed in claim 2 in which the width of each convex stretch is chosen lesser than the width of the corresponding extreme pass by the magnitude of the spread of the corresponding extreme bar.

4. A pair of mating rolls for metal bar rolling, each roll having several grooves of variable cross section located on a surface of the mill roll which contacts workpieces and forms with a corresponding groove on a mating mill roll several passes wherein the bars are rolled, the profile of each said in a direction transversal to the geometric axis of rotation of the mill roll having a cross section formed by an arc of reduction of stock and an arc of division conjugated therewith, the centre of curvature of said arc of reduction being set, with respect to geometric axis of rotation of mill roll at an eccentricity determined by the expression $$e_1 \geqq (D-2\rho_1-H)/(2\cos\delta)$$

where

D = distance between geometric axes of rotation of mill rolls;

$\rho_1$ = radius of curvature of arc of reduction;

H = thickness of workpiece;

$\delta$ = angle between two radii limiting the arc of reduction and drawn from the geometric axis of rotation of mill roll;

the centre of curvature of the arc of division being located with respect to the axis of rotation of the mill roll at an eccentricity of at least half the thickness of web between bars at the end of a transitional length formed in a workpiece by the rolls, the directions of eccentricity alternating in adjacent grooves.

5. A pair of mating mill rolls for rolling a workpiece to form a plurality of finished bars therefrom, the rolls having shaped profiles to define therebetween a plurality of substantially closed passes, the profiles being shaped in such manner that a transitional zone of variable cross section is formed in a workpiece passing through the rolls, the cross section progressively changing from an original cross section to a cross section of several bars off-set from each other, the off-set of adjacent bars being in a direction perpendicular to a longitudinal axis of the workpiece so that adjacent bars are divided from each other.

* * * * *